United States Patent [19]

Arnold

[11] 4,311,428

[45] Jan. 19, 1982

[54] CONNECTORS

[75] Inventor: Carroll H. Arnold, Westminster, Mass.

[73] Assignee: Wain-Roy, Inc., Hubbardston, Mass.

[21] Appl. No.: 39,493

[22] Filed: May 16, 1979

[51] Int. Cl.[3] ..... E02F 3/81

[52] U.S. Cl. ..... 414/723; 37/103

[58] Field of Search ..... 37/117.5, 103, 118 R, 37/118 A; 172/272, 275; 414/723, 705, 694, 695, 607, 394, 686

[56] References Cited

U.S. PATENT DOCUMENTS

| | | | |
|---|---|---|---|
| 2,447,150 | 8/1948 | Anderson | 414/723 |
| 3,389,819 | 6/1968 | Schumacher | 414/723 X |
| 3,512,665 | 5/1970 | Westendorf | 414/723 |
| 3,556,323 | 1/1971 | Heimmermann | 414/723 |
| 3,934,738 | 1/1976 | Arnold | 414/723 |
| 4,127,203 | 11/1978 | Arnold | 414/723 |

*Primary Examiner*—Trygve M. Blix
*Assistant Examiner*—Terrance L. Siemens

[57] ABSTRACT

A system including a hitch adapted for pivotal connection to a boom or dipperstick and including a downwardly projecting hook, and cooperating structure secured to a materials handler and having a cross-member for engaging the hook. A bearing plate secured to the body of the hitch above the hook defines a downwardly-facing bearing surface and engages an upwardly-facing bearing surface secured to the materials handler cooperating structure. In one embodiment, the hitch and materials handler are relatively rotatable about a pin assembly which both connects the relatively rotatable hitch portions and forms the hydraulic cylinder carrying a piston controlling a locking pin.

30 Claims, 14 Drawing Figures

CONNECTORS

FIELD OF THE INVENTION

This invention relates to materials handling and, more particularly, to mounting materials handling tools (e.g., buckets, blades, rippers, augers and the like) on, for example, dippersticks of backhoes.

BACKGROUND OF THE INVENTION

The changing of materials handling tools mounted on a backhoe dipperstick traditionally has been a laborious and timeconsuming job. Some have suggested simplifying this task by connecting different tools to, rather than replacing, the bucket; or by providing connecting mechanisms on the tool and dipperstick which reduce the time and effort required for tool change-over. Such schemes have suffered from various drawbacks, principally the need for precise vertical alignment of the tool and dipperstick, the inability of the backhoe operator to change tools himself, the danger presented by improperly or incompletely connected tools, and the requirement that a different set of tools be provided for each size or type of backhoe. The systems shown in my prior U.S. Pat. No. 3,934,738, issued Jan. 27, 1976, and my copending application Ser. No. 923,379, filed July 10, 1978, permit any of a wide range of materials handling tools to be connected to any type of backhoe, permit a single operator to change tools, often without leaving his seat; eliminate the danger of falling tools, and permit the same tools to be used with either a fixed or a swinging connector. That shown in my prior U.S. Pat. No. 4,127,203, issued Nov. 11, 1978, has most of the advantages of the systems of U.S. Pat. No. 3,934,738 and copending application Ser. No. 923,379, and requires no change to conventional dippersticks and bucket linkages and only slight modification to the conventional tools to be attached thereto. Both of said patents and said application are here incorporated by reference.

SUMMARY OF THE INVENTION

One principal object of the present invention is to provide a tool connecting system having most if not all of the advantages provided by those disclosed in my aforesaid patents and application, and to provide also compensation for wear and variation in manufacturing tolerances, and additional bearing surfaces.

A second principal object is to provide, in addition to the foregoing advantages, an improved locking pin assembly for swinging connectors.

The invention is featured in a system including a hitch adapted for pivotal connection to a boom or dipperstick and cooperating structure secured to a materials handler. The hitch includes a hook projecting downwardly from a hitch body and defining a generally upwardly-facing hook engagement surface, and a hitch locking member spaced longitudinally from the hook. The cooperating structure has a cross-member for engaging the hook engagement surface and, spaced therefrom, a locking member for engaging the hitch locking member. In such a system, one aspect of the invention features a bearing plate secured to the hitch body and defining, above the hook engagement surface, a generally downwardly-facing hitch bearing surface; and, on the materials handler, a cooperating generally upwardly-facing bearing surface disposed for engaging the hitch bearing surface. In a second aspect, particularly in systems in which the hook swings about an axis perpendicular to the axis of pivotal connection of hitch to the boom, there is featured a cylindrical pin the exterior of which connects the hook to and permits swing of the hook relative to the hitch, and the interior of which defines a cylinder bore carrying a piston which connects the hitch and cooperating structure locking members. In preferred embodiments, hitch bearing surfaces are provided on both sides of the hook,the planes of engagement of the hitch and the materials handler bearing surfaces are adjustable in directions perpendicular to the planes, the included angle between the planes of engagement is about 120°, and both the rigid and swinging connectors fit the same tools.

BRIEF DESCRIPTION OF THE DRAWINGS

Other objects, features and advantages of the invention will appear from the following detailed description of a preferred embodiment thereof, taken together with the accompanying drawings in which.

DESCRIPTION OF THE PREFERRED EMBODIMENT

Figure 2:
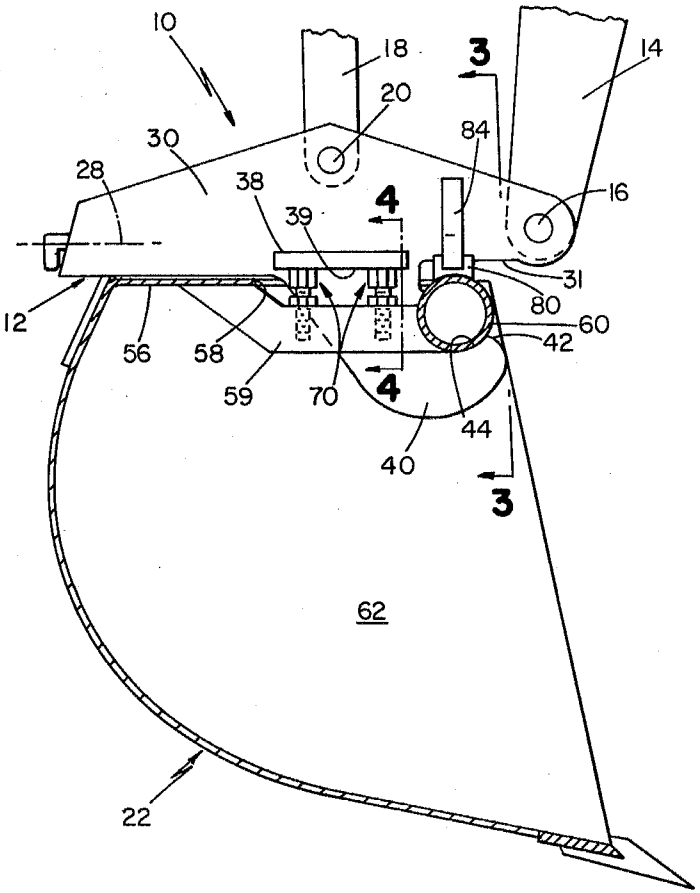
FIGS. 1 and 2 are partially broken away side elevations of portions of a backhoe dipperstick and linkage, and of a hitch and materials handling tool which embody the present invention, the figures being slightly simplified and illustrating different stages in the attachment of the tool to the hitch.

Referring to FIGS. 1 through 4, a hitch, generally designated 10 and including main body 12, is pivotally connected to dipperstick 14 of a backhoe by hinge pin 16 and to guide link 18 by hinge pin 20 to rotate about an axis defined by pin 16, all as described in U.S. Pat. No. 3,934,738. Further details of this connection and its operation may be found in this patent.

Main body 12 comprises a pair of generally vertical side walls 30, to which hinge pins 16 and 20 are connected, a receptacle 32 recessed between plates 30 adjacent the rear end of the body 12, a connecting plate 36 welded betweed side walls 30, and a pair of side bearing plates 38 projecting outwardly from the sides of the main body. As shown, connecting plate 36 and bearing plates 38 are positioned below pin 20, generally midway the length of main body 12. In cross-section, receptacle 32 is a box, open at its bottom, and includes a pair of apertures 34 axially aligned along an axis 28 perpendicular to the axis of pins 16, 20 and extending through its front and rear walls. Support plate 36 and the downwardly-facing bearing surfaces 39 of bearing plates 38 are parallel to both axis 28 and the axes of pins 16, 20.

Each side plate 30 includes a hook 40 projecting downwardly from hitch body 12, generally below hinge pin 20, with the hook nose 42 facing generally towards pin 16. The top of each hook defines an arcuate, upwardly-facing engagement surface 44.

The cooperating structure for permitting engagement of hitch with bucket 22 includes an opening 58 in the top wall 56 of the bucket, a pair of bearing plates 59 welded parallel to bucket side walls 62 and defining the width of opening 58 (a width substantially the same as that of hitch 10); a cylindrical cross-member 60 spanning the width of opening 58 and positioned at the forward end of the opening with its top tangent to the plane of the top of top wall 56; and a laterally centered ear 66 spaced to the rear of opening 58 and projecting upwardly from the rear edge of bucket top wall 56. As shown, ear 66 includes a cylindrical bearing 64 mounted above top wall 56 with its front surface 67 arranged to engage the inner surface 41 of the front wall of receptacle 32 when hitch 10 and bucket 22 are attached, and its bore 68 aligned (by engagement between the top of bearing 64 and a mating crescent 63 on the inside of wall 41) to receive a locking pin 69 extending through the ear 66 (and through apertures 34 of receptacle 32) with the axis of the pin parallel with and above wall 56 and perpendicular to the axis of cross-member 60. For structural rigidity, cross-member 60 spans the width of bucket 22 and is rigidly secured (e.g., welded) to the bucket side walls. Bearing plates 59 are welded at one end to connector 60 and at the other to the underside of top wall 56.

Two adjustable bearings 70, each comprising a hexagonal head bolt threaded into a vertical bore 72 and there fixed by a lock nut 74, project upwardly from each of bearing plates 59. The bearings 70 on each plate 59 are spaced from each other a distance somewhat less than the width (front to rear) of bearing plates 38, one of the bearings 70 being adjacent cross-member60 and the other near the rear of opening 58. The flat tops 76 of bearings 70 define engagement surfaces, those of each pair of adjacent bearings generally lying in the same plane, for engaging surfaces 39 of hitch side bearing plates 38.

A pair of tapered steel wedges 80 is attached to hitch side plates 30, with each wedge bearing against the underside 31 of a respective side plate 30 and arranged to engage the top of cross-member 60. A tension spring 82 (as shown a rubber strip) connects the adjacent, and minimum in cross-section, ends of wedges 10; the outer, and maximum in cross-section, ends of the wedges are attached to the respective ones of side plates 30 by leaf springs 84. If desired, either leaf springs 84 or tension spring 82 may be omitted.

Figure 1:
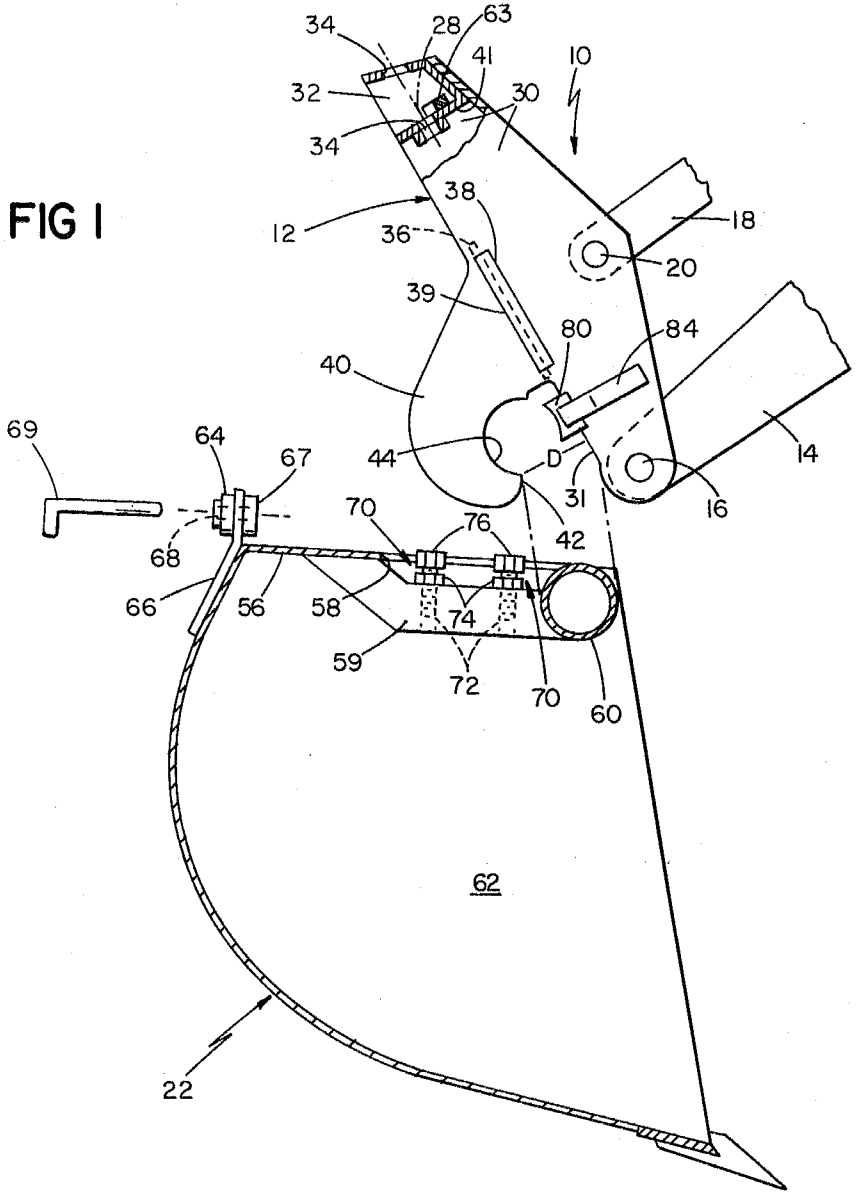
Figure 4:
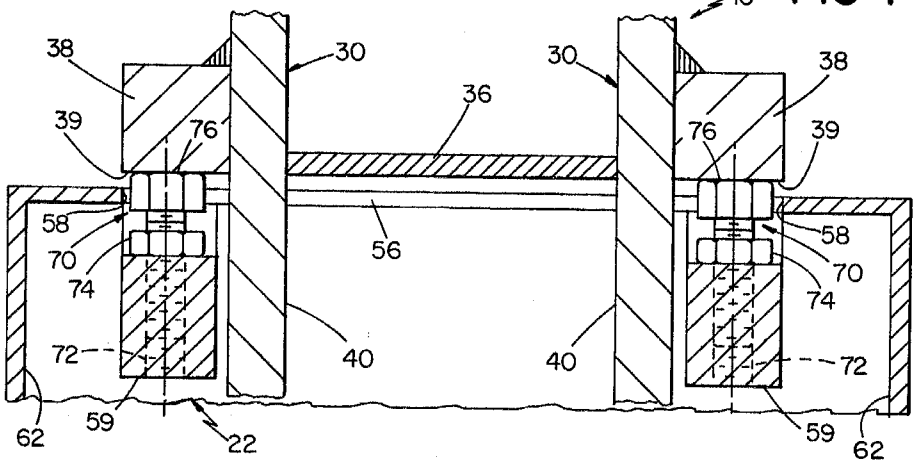
FIG. 4 is a section taken at line 4—4 of FIG. 2.

The operation of hitch 10 and its cooperation with the connecting structure of bucket 22 can be best understood from the sequence illustrated in FIGS. 1–2. As shown in FIG. 1, the hitch is initially positioned above and closely adjacent bucket 22 with hooks 40 laterally and longitudinally aligned with opening 58 in bucket upper wall 56. In this position, the axis of apertures 34 makes an acute angle with the axis of bore 68 in ear 66. The bucket cylinder piston is then extended, causing hitch 10 to rotate about pin 16 and inserting hooks 40 into opening 58. As the hitch is rotated, upwardly-facing hook engagement surfaces 44 engage and slide under cross-member 60, the minimum distance D between surfaces 44 and the underside 31 of hitch body 12 being slightly greater than the diameter of cross-member 60. Simultaneously the angle between the axes of apertures 34 and bore 68 diminishes. Continued rotation of hitch 10 about the axis of pin 16 results in the hook surfaces 44 sliding completely under cross-member 60 and bearing surfaces 39 coming into engagement with the tops of bearings 70, all as shown in FIG. 2. In this position, the engagement between bearing surfaces 39 and bearings 70 pulls hook surfaces 44 up hard against the underside of cross-member 60, and provides also a "stop" for precise relative vertical alignment of the hitch and bucket, with apertures 34 of receptacle 32 aligned with bore 68 of ear 66. Locking pin 69 may then be manually inserted into bore 68 and apertures 34 from the rear of the bucket and locked in position with an over-center lynch pin.

Wedges 80 help insure a tight fit between cross-member 60 and the undersides 31 of plates 30. As is evident, springs 82, 84 draw wedges 80 together, increasing the thickness of the wedge portion directly below and engaging plate undersides 31. When the hitch and tool are being connected together or taken apart, the wedges 80 must manually be pulled far apart (and if no leaf springs 84 are used often completely removed) to permit cross-member 60 to fit between plate undersides 31 and hook surfaces 44. The wedges are reinserted after the hitch and tool have abeen connected; and make the fit far tighter. In the illustrated embodiment, the undersides of the wedges 80 are partially cylindrical to fit snugly partially around cross-member 60.

OTHER EMBODIMENTS

Figure 5:
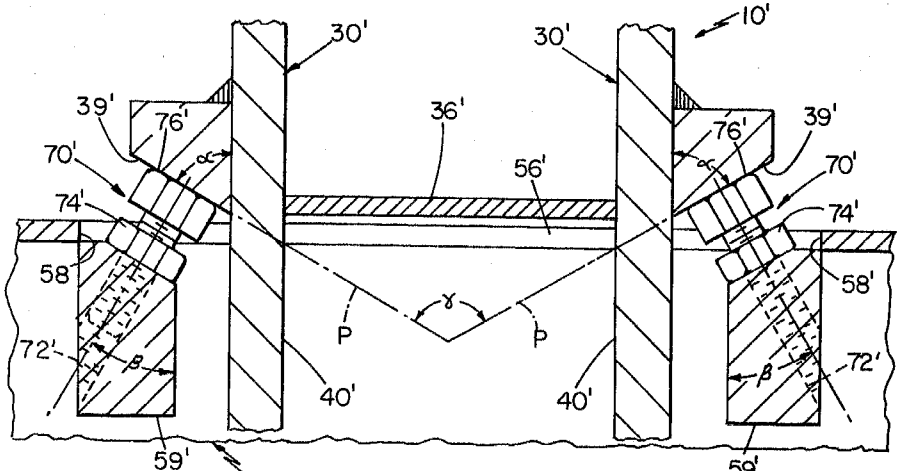

FIG. 5 illustrates a modified embodiment in which bearing surfaces 39′ and bearings 70′ (and thus the planes in which they engage each other) are inclined rather than parallel relative to the plane including the axes of the hinge and link pins (16, 18 in the FIGS. 1–4 embodiment) and of the link pin aperture (axis 28 in FIGS. 1–4). As shown, surfaces 39′ form angles $\alpha$ (in the illustrated embodiment about 60°) with vertical sides of side plates 30′; and the angles $\beta$ between the axis of bores 72′ (and of bearings 70′) and the vertical sides of bearing plates 59 are complementary (in the illustrated embodiment about 30°). The upwardly-facing angle $\gamma$ between the planes P of engagement of bearing tops 76′ and surface 39′, thus, is about 120°.

Figure 6:
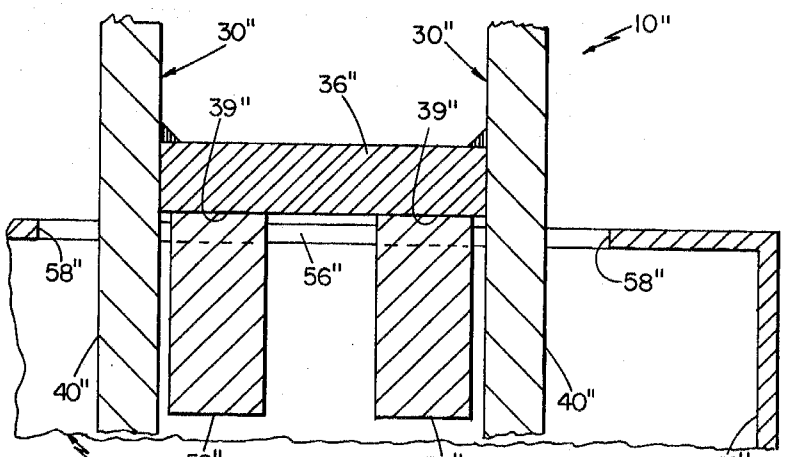
FIGS. 5 and 6 show modifications of the structure shown in FIG. 4.
Figure 3:
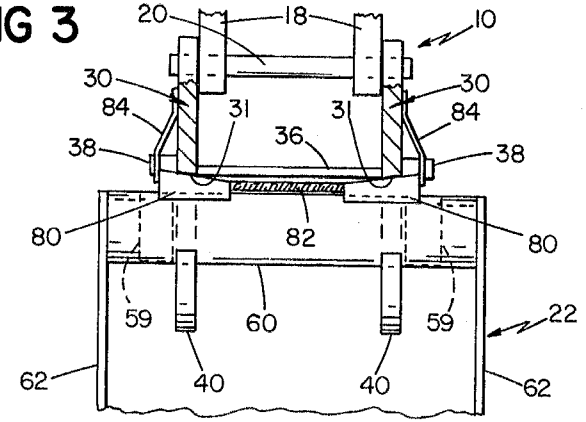
FIG. 3 is a section taken at line 3—3 of FIG. 2.

In FIG. 6, bearing plates 59″ are positioned between, rather than outside, sidewalls 30″ and hooks 40″, and the flat tops of bearing plates 59″ engage the flat underside of reinforced connecting plate 36″. This interior arrangement makes the provision of outside bearing plates, such as bearing plates 38 in FIGS. 1–4, unnecessary. In the FIG. 6 embodiment, wear and manufacturing tolerance variation may be adjusted for with shims (not shown) or, if desired, bearings such as bearings 70 may be mounted in bores in either the tops of bearing plates 59″ or the underside of connector plate 36″.

Figure 8:
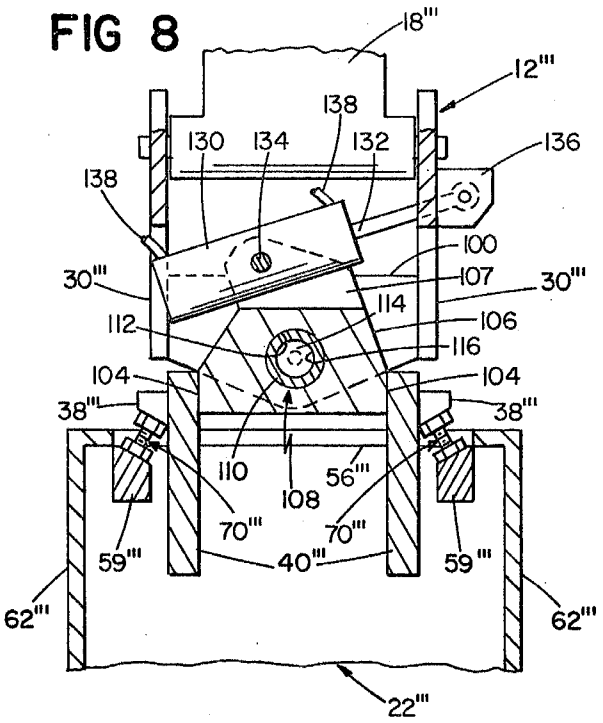
FIG. 8 is a section taken at line 8—8 of FIG. 7.
Figure 7:
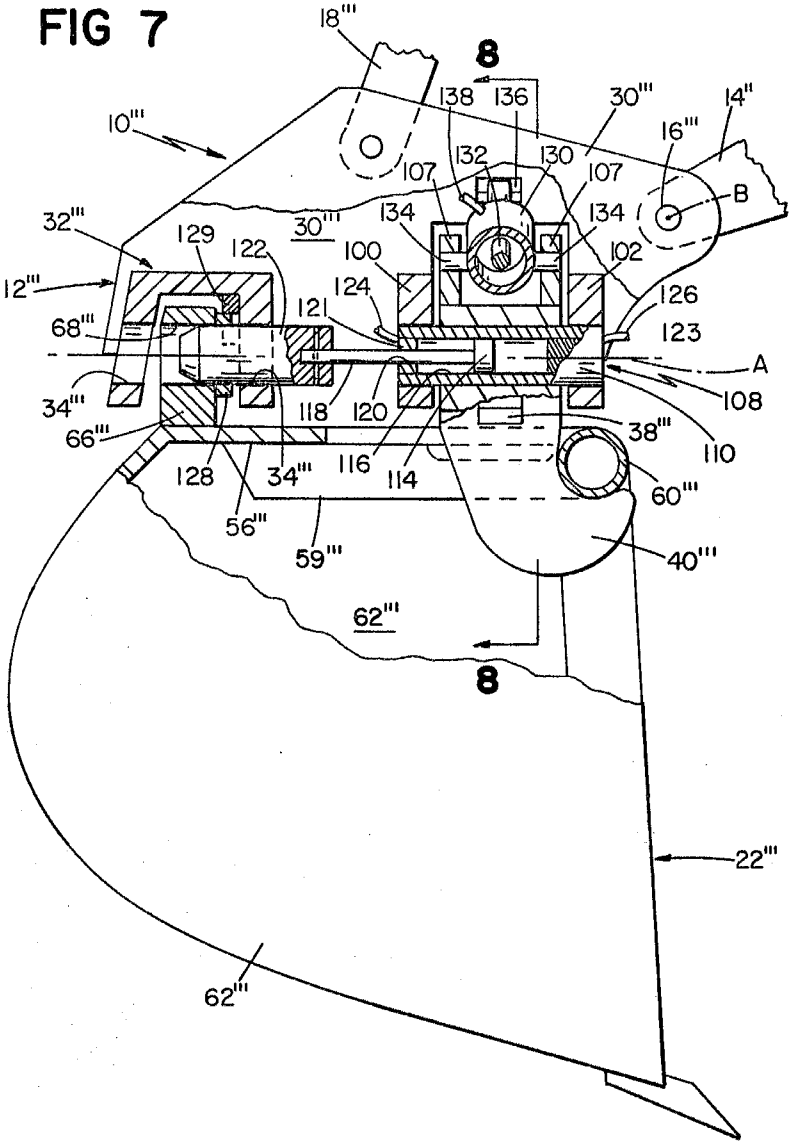
FIG. 7 is a side elevation, partially in section, of a further embodiment.

FIGS. 7 and 8 disclose a system in which the hitch 10‴ is a swinging connector permitting bucket 22‴ pivot relative to the hitch main body 12‴ about an axis A perpendicular to that (axis B of pin 16‴) about which the hitch pivots relative to dipperstick or boom 14‴. As shown, a pair of parallel supports 100, 102, spaced apart from each other along axis A, extend between the side wall plates 30‴ of hitch body 12‴ adjacent the front and rear of hooks 40‴. Hooks 40‴, rather than being projections of side plates 30‴, are separate plates welded to opposite sides 104 of a support block 106, which itself is mounted between supports 100, 102 by pin assembly 108. As shown, sides 104 and hooks 40‴ are parallel to, and pin assembly 108 is coaxial with, axis A. A pair of pivot plates 107, spaced axially along and perpendicular to axis A, are welded on top of block 106.

Pin assembly 108 comprises a cylindrical pivot pin 110 journaled in aligned bores in supports 100, 102 and extending through a bore 112 in support block 106, a piston 114 in an axial cylindrical bore 116 within pivot pin 110, and a piston rod 118 extending through a bore 120 in the rear end cap 121 of bore 112 and carrying a coaxial latch pin 122. Hydraulic lines 124, 126 connect with bore 116 on opposite sides of piston 114. Latch pin 122 is aligned with, and arranged to extend through, apertures 34''' in receptacle 32'''; and, when hitch 10''' and bucket 22''' are connected, also through bore 68''' in ear 66'''. A cylindrical boss 128 on the front of ear 66''' and a mating crescent 129 on receptacle 32''' provide accurate vertical alignment of the ear within the receptacle, so that the axes of apertures 34''' and bore 68''' will be coaxial with each other and with axis A.

Conventional hydraulic cylinder 130 and piston 132 are secured between pivot plates 107 by pivot pins 134 extending from opposite sides of cylinder 130 through aligned bores in pivot plates 107. Piston 132 is connected to a projecting abutment 136 on side plate 30'''. Hydraulic lines 138 provide for flow of fluid into and from cylinder 130.

As will be evident, extending and retracting piston 132 within cylinder 130 causes block 106 (and thus hooks 40''' and bucket 22''' attached thereto) to rotate about pin assembly 108 (i.e., axis A). Pin assembly 110 additionally forms the hydraulic cylinder for piston 114 that, as can be seen in FIG. 7, causes latch pin 122 to move axially into and out of locking engagement with receptacle 32''' and ear 66'''.

FIGS. 9–11*a* illustrate modified systems for connecting the rear (i.e., the end spaced from the hook) of the hitch to the rear (i.e., the end spaced from the cross-member) of the bucket cooperating structure.

Figure 9:
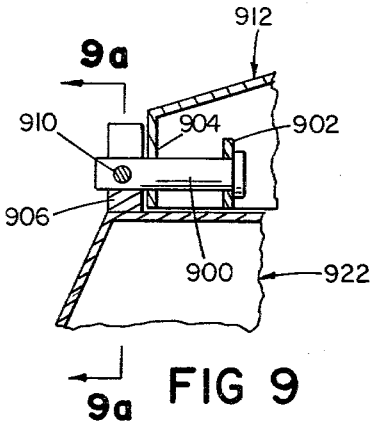
FIGS. 9–11*a* are sectional views of further modifications.
Figure 9A:
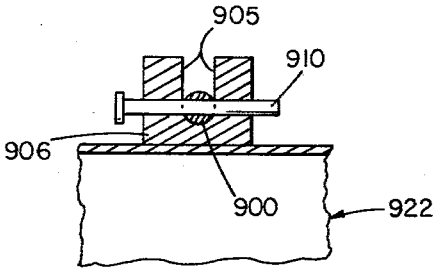

In FIGS. 9 and 9*a*, a connector pin 900 is journalled in bearings 902, 904 at the rear of hitch body 912. With the hitch body and bucket 922 connected together, pin 900 bottoms out in a U-shaped recess 905 in an upstanding bracket 906 at the rear of bucket 922; and is held in place by a retention pin 910 fitted in aligned bores through the sides of bracket 906 and connector pin 900. Pin 910 is itself held in place by a cotter pin (not shown).

Figure 10:
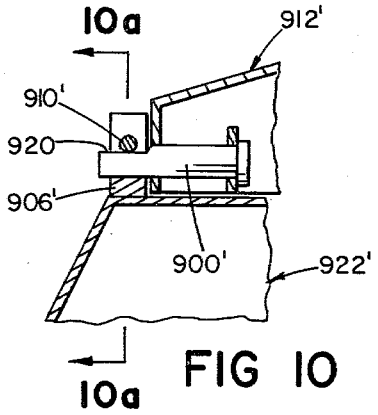
Figure 10A:
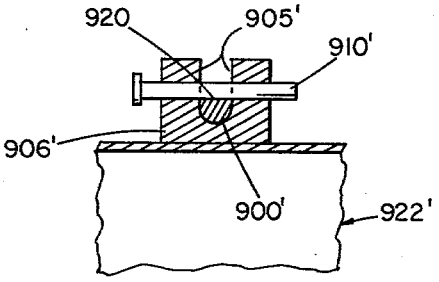

The arrangement shown in FIGS. 10 and 10*a* is similar to that in FIG. 9, except that a flat 920 is cut into the top of connector pin 900' to provide a bearing surface for the underside of connector pin 910' which fits over, rather than passing through, connector pin 900'.

Figure 11:
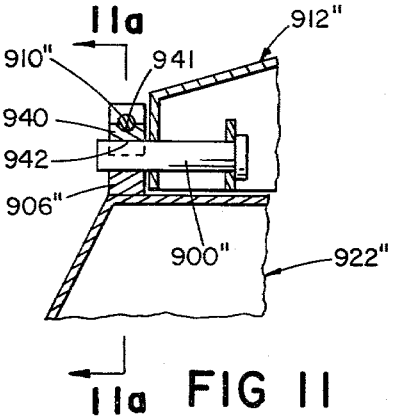
Figure 11A:
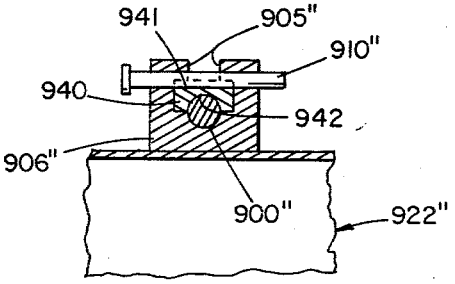

The FIGS. 11–11A system provides even greater bearing surface. A retaining block 940 fits in grooves in bracket 906'' above connector pin 900''. As shown, a semicylindrical recess 942 in the bottom of block 940 engages the top of pin 900''; and retention cross-pin 910'' engages a similar recess 941 in the top of the block. As should be evident, this system (unlike those of FIGS. 9–10*a*) can be used with rotating as well as with non-rotating hitches.

In other embodiments, cross-member 60 may be square, rectangular or irregular in cross-section; and the undersides of wedges 80 will be shaped to conform. Wedges 80, either as shown or modified in the respects discussed, may be used in systems similar to those shown in aforementioned U.S. Pat. No. 3,934,738 and copending application Ser. No. 923,379.

What is claimed is:

1. In a system comprising a hitch adapted for pivotal connection to a boom for rotation about an axis and including a hook member projecting downwardly from a hitch body and defining a generally upwardly-facing hook engagement surface, and cooperating structure secured to a materials handler and including an opening for receiving said hook member and a cross-member extending transversely across said opening in position for engaging said hook engagement surface, that improvement wherein:

said hitch body includes a pair of spaced parallel, generally vertical side plates;

a hitch bearing plate is secured to and projects generally perpendicularly from one of said side plates defines a generally planar downwardly-facing bearing surface, a cooperating structure bearing is secured to said cooperating structure and defines a generally planar upwardly-facing bearing surface disposed for engaging said hitch bearing surface, said cooperating structure bearing surface being located intermediate said cross-member and a transverse edge of said opening.

2. The system of claim 1 wherein said cooperating structure bearing includes a pair of generally parallel transversely spaced support members extending generally perpendicular to said axis.

3. The system of claim 1 wherein said cooperating structure bearing includes a support member welded at one end thereof to said cross-member and extending generally perpendicular to said axis.

4. The system of claim 3 including a pair of said support members positioned generally parallel to and spaced transversely relative to each other.

5. The system of claim 1 wherein said hitch includes a pair of said hitch bearing plates projectng outwardly in opposite directions from respective ones of said side plates and defining respective generally co-planar downwardly-facing bearing surfaces.

6. The system of claim 1 wherein said hitch bearing plate is secured to and extends between said side plates.

7. The system of claim 1 wherein one of said hitch and cooperating structure bearing surfaces is adjustable in directions perpendicular to the plane thereof.

8. The system of claim 7 wherein the adjustable said one of said bearing surfaces is defined by the head of a threaded member fitted within a threaded bore the axis of which is generally perpendicular to said one of said bearing surfaces.

9. The system of claim 8 wherein said threaded member defines said cooperating structure bearing surface.

10. The system of claim 1 wherein said hitch includes two of said hitch bearing surfaces inclined relative to each other, and said cooperating structure includes two of said cooperating structure bearing surfaces each arranged to engage a respective one of said hitch bearing surfaces.

11. The system of claim 10 wherein the planes including said cooperating bearing surfaces define an upwardly-facing angle of about 120°.

12. The system of claim 10 wherein said hitch includes two hitch bearing plates each projecting outwardly from a side of a respective one of said hitch side plates and defining a said hitch bearing surface.

13. The system of claim 1 wherein one of said hitch and said cooperating structure includes two pairs of adjustable members, each of said adjustable members defining a said bearing surface and being adjustable to move said bearing surface thereof in directions generally perpendicular to the plane thereof, and the adjustable members of each of said pairs being spaced along a respective line generally perpendicular to said axis.

14. The system of claim 13 wherein each of said adjustable members comprises a threaded shaft fitted into a threaded bore in one of said hitch and said cooperating structure, a head at one end of said shaft defining said bearing surface thereof.

15. The system of claim 14 wherein said cooperating structure includes a pair of generally parallel transversely spaced supporting members extending from said cross member generally perpendicular to said axis, and a said pair of adjustable members is mounted on each of said support members.

16. The system of claim 2 or claim 14 wherein said support members are positioned along and define the opposite side edges of said opening, and said hook is adapted to fit between said support members.

17. The system of claim 1 wherein each of said side plates has a downwardly-facing lower edge above said hook engagement surface, and including a pair of tapered wedges each mounted below a said lower edge with the upper surface thereof engaging said lower edge and the bottom surface thereof positioned to engage an upper surface of said cross member, said wedges being movable relative to sides in engagement with said lower edges such as to vary the distances from each of said lower edges to the bottom surface of the wedge in engagement therewith and being biased in directions to increase said distances.

18. The system of claim 1 wherein a said hook member projects downwardly from each of said side plates.

19. The system of claim 1 wherein said hitch includes a connecting pin extending generally perpendicular to and spaced from said axis, said materials handler cooperating structure includes an upstanding bracket defining a recess open at its top for receiving said connecting pin, and further including means for locking said connecting pin in position within said recess.

20. The system of claim 19 wherein said means for locking includes a locking pin supported by said bracket, and extending transversely across said recess in a direction generally perpendicular to the axis of said connecting pin.

21. The system of claim 20 wherein said locking pin engages said connecting pin.

22. The system of claim 20 including a retaining block mounted in said recess intermediate said locking and connecting pins; said connecting pin being rotatable relative to and in engagement with said recess and block.

23. In a system comprising a hitch adapted for pivotal connection to a boom for rotation about an axis and including a hook member projecting downwardly from a hitch body and defining a generally upwardly-facing hook engagement surface, and cooperating structure secured to a materials handler and including an opening for receiving said bearing member and a cross member extending transversely away from said opening in position for engaging said hook engagement surface, that improvement wherein:

said hitch body defines a pair of transversely spaced downwardly facing edges above said hook engagement surface;

a tapered wedge having relatively inclined top and bottom surfaces is mounted below each of said downwardly-facing edges for movement relative thereto with the top surface of said wedge in engagement with said edge and the bottom surface of said wedge in position for engaging said cross member; and, biasing means engages each of said wedges and tends to move said each wedge relative to the edge in engagement therewith in a direction such as to increase the distance from said edgeto said bottom surface of said wedge.

24. The system of claim 23 wherein said bottom surfaces of said wedges and the upper surface of said cross member are complementary.

25. The system of claim 23 wherein said wedges are mounted in alignment with and biased towards each other along a line generally parallel to said axis.

26. In a system for releasably securing a materials handler to a boom while permitting rotation of said materials handler relative to said boom about a first axis fixed with respect to said boom and a second axis generally perpendicular to said first axis, said system including a hitch having first and second hitch portions connected to each other for relative rotation about said second axis, said first hitch portion being adapted for pivotal connection to said boom for rotation relative thereto about said first axis and including a first connector adapted for connection to said materials handler, and said second hitch portion including a second connector adapted for connection to said materials handler, and materials handler cooperating structure having a first connector adapted for connection to said first connector of said hitch first portion and a second connector, each of said first connectors defining a respective bore coaxial with said second axis when said materials handler is connected to said hitch, that improvement comprising:

a cylindrical pin extending along said second axis through coaxial bores in said first and second hitch portions and connecting said hitch portions for said relative rotation about said second axis;

a bore within said pin extending coaxially of said pin;

a piston mounted within said bore; and a piston rod connected to said piston, extending through an end of said cylinder, and including a connecting pin portion adapted for seating within said bores of first and second connectors, said piston being movable within said bore to move said connecting pin portion between a first position within said bores and connecting said first and second connectors and a second position spaced along said second axis from said first position in which said first and second connectors are free to move relatively apart.

27. The system of claim 26 wherein said cylindrical pin is journaled within said coaxial bores in said first and second hitch portions, the outer surface thereof providing a bearing surface for said relative rotation of said hitch portion.

28. The system of claim 26 wherein said hitch includes a hook member projecting downwardly from a hitch body and defining a generally upwardly-facing hook engagement surface, said cooperating structure is secured to said materials handler and includes an opening for receiving said hook member and a cross-member extending transversely across said opening in position for engaging said hook engagement surface, said hitch body includes a pair of spaced parallel, generally vertical side plates, a hitch bearing plate is secured to and projects generally perpendicularly from one of said side plates and defines a generally planar downwardly-facing bearing surface, and a cooperating structure bearing is secured to said cooperating structure and defines a generally planar upwardly-facing bearing surface disposed for engaging said hitch bearing surface, said cooperating structure bearing surface being located intermediate said cross-member and a transverse edge of said opening.

29. The system of claim 26 wherein said hitch includes a hook member projecting downwardly from a hitch body and defining a generally upwardly-facing hook engagement surface, said cooperating structure is secured to said materials handler and includes an opening for receiving said bearing member and a cross member extending transversely across said opening in position for engaging said hook engagement surface, said hitch body defines a pair of transversely spaced downwardly facing edges above said hook engagement surface, a tapered wedge having relatively inclined top and bottom surfaces is mounted below each of said downwardly-facing edges for movement relative thereto with the top surface of said wedge in engagement with said edge and the bottom surface of said wedge in position for engaging said cross member, and biasing means engages each of said wedges and tends to move said each wedge relative to the edge in engagement therewith in a direction such as to increase the distance from said edge to said bottom surface of said wedge.

30. The system of claim 26 wherein said second hitch portion comprises a support defining said coaxial bore thereof and a pair of hook members extending downwardly from opposite sides of said support in respective planes parallel to and on opposite sides of said second axis.

* * * * *